US008607390B2

(12) United States Patent
Obriot et al.

(10) Patent No.: US 8,607,390 B2
(45) Date of Patent: Dec. 17, 2013

(54) STRUCTURE FOR SUSPENDED BEDDING

(75) Inventors: Kelly M. Obriot, Grosse Pointe Park, MI (US); Julie Andreae, Grosse Pointe Farms, MI (US)

(73) Assignee: Secure Beginnings, LLC, Detroit, MI (US)

( * ) Notice: Subject to any disclaimer, the term of this patent is extended or adjusted under 35 U.S.C. 154(b) by 0 days.

(21) Appl. No.: 13/496,912

(22) PCT Filed: Sep. 21, 2010

(86) PCT No.: PCT/US2010/049606

§ 371 (c)(1), (2), (4) Date: Mar. 19, 2012

(87) PCT Pub. No.: WO2011/035285

PCT Pub. Date: Mar. 24, 2011

(65) Prior Publication Data

US 2012/0180217 A1 Jul. 19, 2012

Related U.S. Application Data

(60) Provisional application No. 61/244,194, filed on Sep. 21, 2009.

(51) Int. Cl.
*A47C 23/14* (2006.01)

(52) U.S. Cl.
USPC ..... 5/724; 5/652.1; 5/423

(58) Field of Classification Search
USPC ..... 5/724–726, 652.1, 652.2, 423
See application file for complete search history.

(56) References Cited

U.S. PATENT DOCUMENTS 2,963,712 A * 12/1960 Cole ..... 5/186.1
5,561,876 A * 10/1996 Petruzella ..... 5/724

(Continued)

FOREIGN PATENT DOCUMENTS

GB 2310133 A 8/1997
JP 2004-283196 A 10/2004

(Continued)

OTHER PUBLICATIONS

International Search Report and Written Opinion for PCT/US2010/049606, mailed Feb. 25, 2011; ISA/KR.

(Continued)

*Primary Examiner* — Michael Trettel
(74) *Attorney, Agent, or Firm* — Brooks Kushman P.C.

(57) ABSTRACT

A bedding apparatus may include a first fabric layer, a second fabric layer, and a frame. The first fabric layer may allow passage of fluid therethrough. The second fabric layer may also allow passage of fluid therethrough. The second fabric layer may be connected to the first fabric layer to form a gap therebetween. The frame may engage at least one of the first and second fabric layers and retain the first and second fabric layers in a taut condition.

23 Claims, 9 Drawing Sheets

(56) References Cited

U.S. PATENT DOCUMENTS

| | | | | |
|---|---|---|---|---|
| 5,664,273 | A * | 9/1997 | Obriot | 5/724 |
| 5,857,232 | A * | 1/1999 | Mahdavi | 5/655 |
| 6,370,718 | B1 * | 4/2002 | Schmid | 5/726 |
| 6,425,152 | B1 * | 7/2002 | Quarles | 5/655 |
| 6,438,775 | B1 | 8/2002 | Koenig | |
| 6,684,437 | B2 * | 2/2004 | Koenig | 5/726 |
| 6,854,143 | B2 * | 2/2005 | Sharples | 5/724 |
| 7,614,098 | B1 * | 11/2009 | Quarry | 5/111 |
| 2007/0061961 | A1 | 3/2007 | Shamie | |
| 2007/0289060 | A1 | 12/2007 | Berkey | |
| 2009/0188048 | A1 * | 7/2009 | Shlomo | 5/691 |

FOREIGN PATENT DOCUMENTS

| | | | |
|---|---|---|---|
| KR | 20-0291207 | Y1 | 10/2002 |
| KR | 20-0360517 | Y1 | 8/2004 |
| WO | 2008018060 | A2 | 2/2008 |

OTHER PUBLICATIONS

Extended European Search Report for corresponding Application No. 10818008.4, mailed Sep. 12, 2013, 8 pages.

* cited by examiner

STRUCTURE FOR SUSPENDED BEDDING

CROSS-REFERENCE TO RELATED APPLICATIONS

This application is a 371 U.S National Stage of International Application Ser. No. PCT/US2010/049606,filed Sep. 21, 2010,and claims priority to U.S. provisional application No. 61/244,194, filed on Sep. 21, 2009, the disclosures of which are herein incorporated by reference in their entirety.

FIELD

The present disclosure relates to a bedding apparatus, and more particularly to a structure for a suspended bedding apparatus.

BACKGROUND

This section provides background information related to the present disclosure and is not necessarily prior art.

Infants, toddlers, and occasionally small children tend to sleep in cribs. Traditional cribs are often purchased along with a traditional foam or spring mattress in as set. When an infant expels bodily fluids in the crib, these mattresses may become unsanitary, as the bodily fluids may tend to pool or collect around the infant's body. Cleaning these mattresses can be cumbersome and sometimes ineffective, as the bacteria, germs and other matter can become embedded in the mattress. These traditional mattresses can also inhibit the infant's breathing and/or cause the infant to re-breath exhaled carbon dioxide. Furthermore, infants have been known to develop physical deformities as a result of a prolonged contact between a traditional mattress and the infant's skull.

SUMMARY

This section provides a general summary of the disclosure, and is not a comprehensive disclosure of its full scope or all of its features.

In one form, the present disclosure provides a bedding apparatus that may include a first fabric layer, a second fabric layer, and a frame. The first fabric layer may allow passage of fluid therethrough. The second fabric layer may also allow passage of fluid therethrough. The second fabric layer may be connected to the first fabric layer to form a gap therebetween. The frame may engage at least one of the first and second fabric layers and retain the first and second fabric layers in a taut condition.

In another form, the present disclosure provides a bedding apparatus that may include a base, a frame, and a fabric layer. The base may include a cavity. The frame may be mounted to the base and may include first and second members. The first member may be pivotable relative to the second member between a first position and a second position. The fabric layer may engage the first and second members and extend therebetween to form a bedding structure suspended over the cavity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
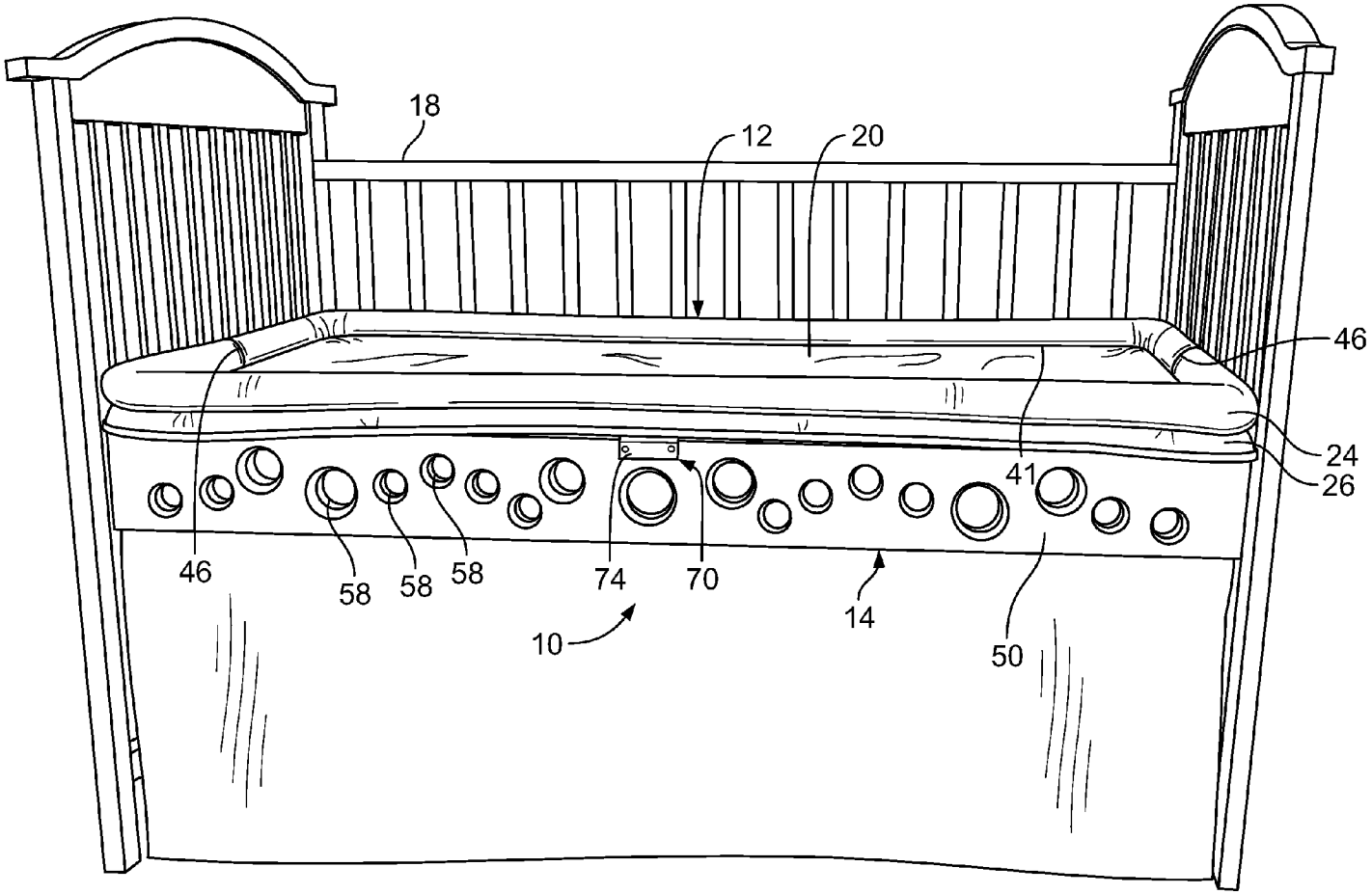
FIG. 1 is a perspective view of an bedding apparatus installed in a crib according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments. Furthermore, designating or describing an element, component, region, layer or section as a first element, component, region, layer or section does not necessarily require the presence or inclusion of a second element, component, region, layer or section.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-6, a bedding apparatus 10 is provided and may include a cover 12, a base 14, and a frame 16. The bedding apparatus 10 may be suitable for use by babies, infants, toddlers, and/or young children (hereinafter collectively referred to as "children"), for example. As shown in FIG. 1, the bedding apparatus 10 may be mounted or retrofitted to a traditional crib 18. In other embodiments, the bedding apparatus 10 may be mounted to a cradle or a bassinet. In still other embodiments, the bedding apparatus 10 may be a stand-alone unit that can be placed on a floor or other surface. As will be subsequently described, the bedding apparatus 10 provides safe, hygienic and comfortable bedding for children.

The cover 12, which replaces a traditional mattress structure, according to the teachings of the present disclosure, may include an upper layer 20, a lower layer 22, a bumper 24, and a skirt 26. When employed in a standard crib 18, the cover 12 may have length and width dimensions of about fifty one (51) by twenty seven (27) inches (1295.4 millimeters by 685.8 millimeters), for example. In other configurations, the cover may have length and width dimensions of about fifty three and one half (53.5) inches by about thirty (30) inches (1359 millimeters by 762 millimeters), for example. It will be appreciated that the cover 12 could include any other length and width dimensions suitable for bedding used by children.

The upper layer 20 may be formed from a "spacer" fabric including fluid-wicking yarns or fibers that are warp-knitted in an open-weave fashion. The upper layer 20 may be a knitted mesh including sinusoidal mesh strands extending generally parallel to each other. The strands are spaced apart from each other and connected to each other via a plurality of threads or a plurality of groups of threads that are spaced apart from each other. In this manner, the strands and threads of the fabric of the upper layer 20 cooperate to form a mesh having a plurality of polygonal, circular or oval-shaped holes. The upper layer 20 is permeable to fluids, dissipates heat and facilitates airflow therethrough. Preferably, the spacer fabric will include a top panel in contact with the child, formed from micro-denier fibers, a bottom panel which supports the top panel and a "spacer" upon which sticks the top and bottom panels together to form a three dimension fabric. An example of a suitable micro denier fiber would be spun polyester fibers having an average denier of 70 or more. Examples of suitable "spacer" fabric include a three-dimensional knit spacer fabric marketed under the brand name $D^3$ manufactured by Gehring Textiles, Inc. in Garden City, N.Y. Another suitable material for the upper layer 20 is marketed under the name 3MESH manufactured by Muller Textil located in Germany. In some configurations, the upper layer 20 may be one hundred percent monofilament polyester that may be fire resistant, mildew resistant, and resistant to alkaloids and acids. Other materials and fabrics may be used that allow air to relatively easily and passively flow through the upper layer 20 and are capable of performing the functionality described herein.

Figure 5:
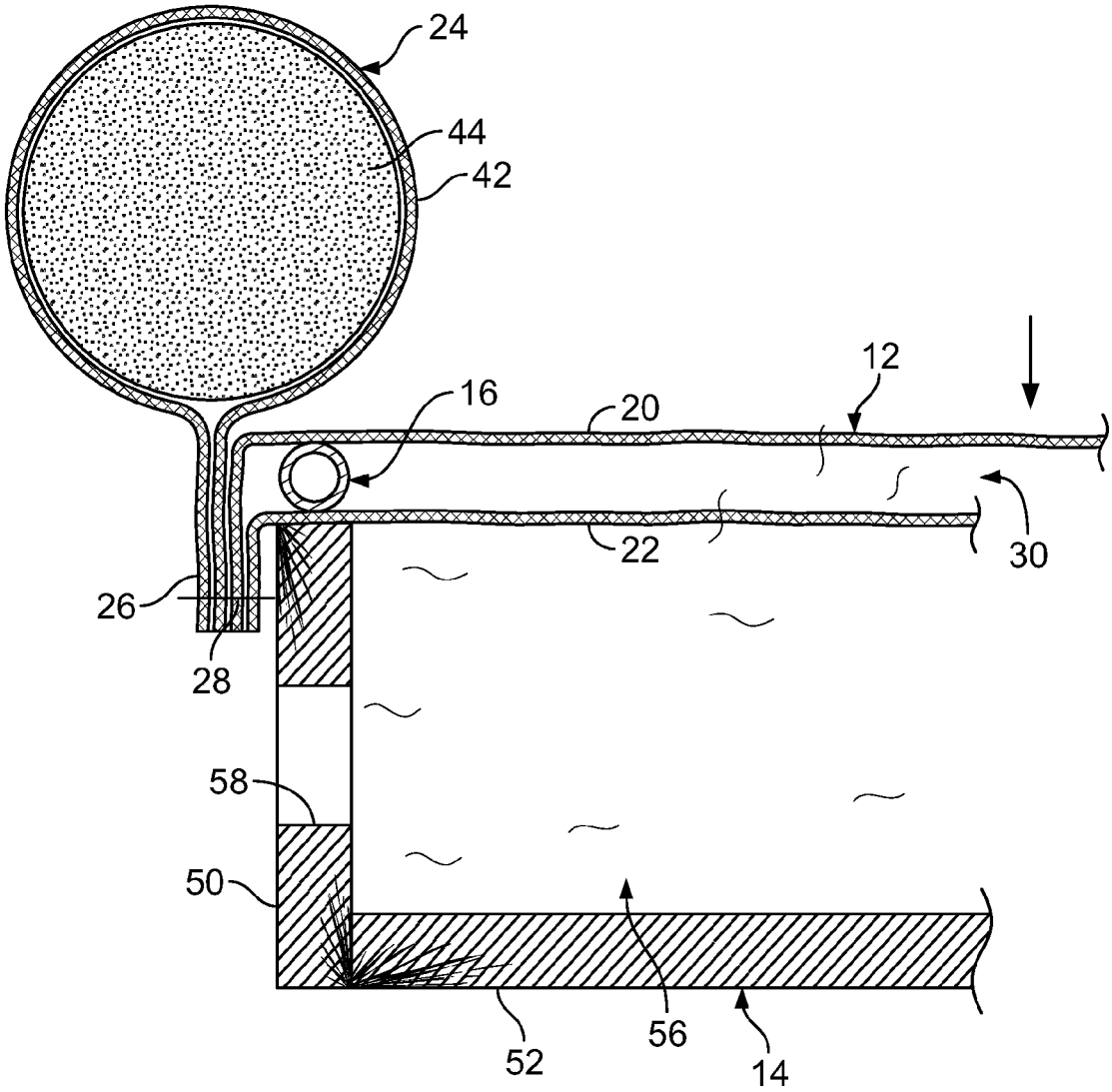
FIG. 5 is a partial cross-sectional view of the bedding apparatus according to the principles of the present disclosure.

The lower layer 22 may be formed from a spacer fabric or a breathable polyester netting, for example, that may be substantially inelastic and dimensionally stable such that the lower layer has little or no stretch when placed under tension loads. A stitched joint 28 may connect the lower layer 22 to the upper layer 20, generally along respective edges thereof, thereby forming a gap 30 between the upper layer 20 and the lower layer 22 (FIG. 5).

Figure 3:
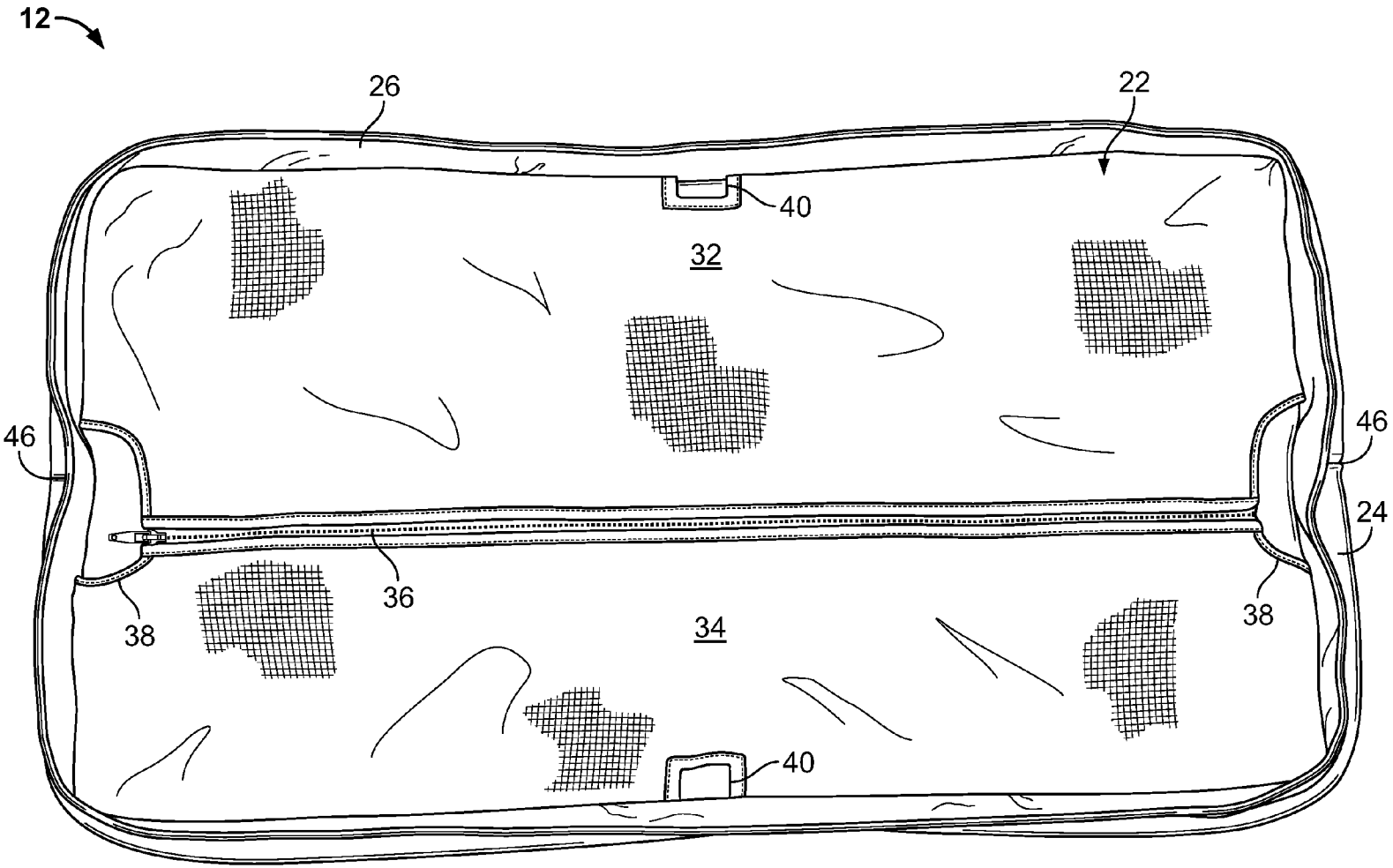
FIG. 3 is a bottom view of the bedding structure of FIG. 2.

As shown in FIG. 3, the lower layer 22 may include a first panel 32 and a second panel 34. The first and second panels 32, 34 may be selectively connected to each other via a flat coil zipper 36 or other closure. The first panel 32 may include a larger surface area than that of the second panel 34, thereby offsetting the zipper 36 from the center of the cover 12. The lower layer 22 may also include a first relief or cutout 38 at opposing ends of the zipper 36 and openings 40 positioned across the width of the lower layer 22 for clearance for a latching mechanism, as will be subsequently described.

Figure 2:
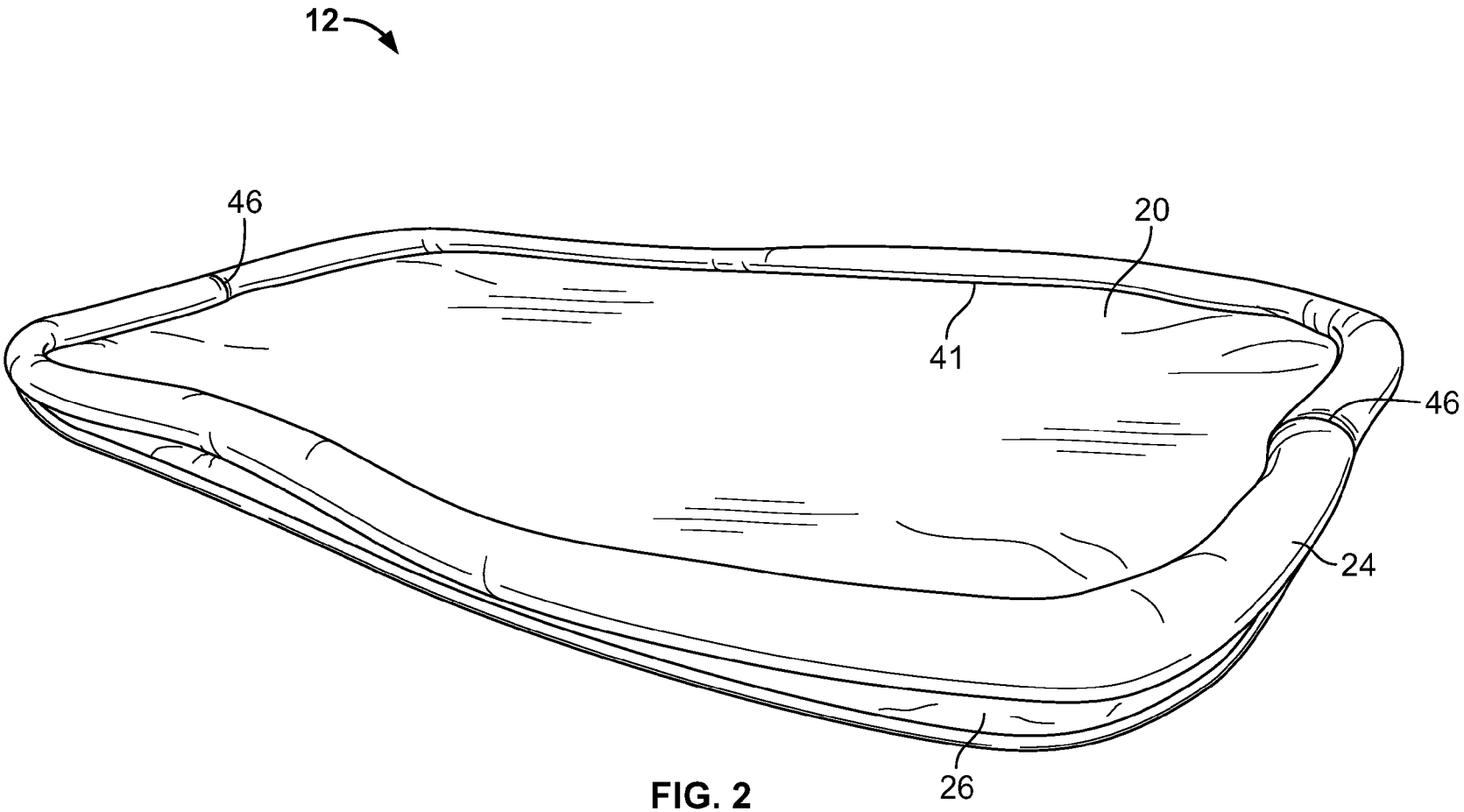
FIG. 2 is a perspective view of a bedding structure of the bedding apparatus of FIG. 1.

The bumper 24 may be an elongated member extending around a perimeter 41 of the cover 12, as shown in FIGS. 1 and 2. The bumper 24 may be sized and positioned relative to the upper and lower layers 20, 22 to provide a barrier and cushion over the frame 16 to protect a child lying in the bedding apparatus 10. The bumper 24 may include a fabric outer layer 42 encasing a filler material 44 to form a generally circular cross section, for example. By way of non-limiting example, the bumper 24 may include a diameter of about one and one half (1.5)-two and one half (2.5) inches (38-64 millimeters). The outer layer 42 may be formed from the breathable spacer fabric described above, for example, and may be connected to the upper and lower layers 20, 22 at the stitched joint 28. The filler material 44 may be a resiliently compressible material. One example includes a six-layer polyester filler material manufactured by Petco Sackner and sold under the product designation jute braided polyester. Of course, other suitable cushioning material will work. The bumper 24 may also include a break or slit 46 at opposing ends of the cover 12 to facilitate installation and removal of the cover 12 from the frame 16. It will be appreciated that the structure of the bumper 24 is not limited to the structure described above, and may include alternatively configured dimensions and/or materials.

The skirt 26 may extend downward (relative to the view shown in FIG. 1) from the stitched joint 28 connecting the upper layer 20, the lower layer 22, and the bumper 24. The skirt 26 may be formed from excess material of the upper layer 20, the lower layer 22, and the bumper 24. The skirt 26 may be configured to conceal gaps between the cover 12 and the frame 16. The length and configuration of the skirt 26 may be formed in any suitable manner to facilitate the particular aesthetic and performance objectives of the bedding apparatus 10.

The base 14 may support the cover 12 and the frame 16 and may include a plurality of vertically-extending sidewalls 50 connected to a base-plate 52. The sidewalls 50 may be connected to the base-plate 52 via fasteners, adhesive bonding, lap joints, dovetail joints, and/or any other suitable joining means. In the particular embodiment shown in FIGS. 1 and 4-6, the base 14 may include four vertically-extending sidewalls 50 cooperating with the base-plate 52 to form a generally rectangular box. The sidewalls 50 and the base-plate 52 may be formed from wood, a polymeric material, and/or a metallic material, for example, and include sufficiently robust construction to support the weight of the cover 12, the frame 16 and a child situated thereon. As will be subsequently described, the frame 16 and cover 12 may be mounted to topsides 54 of the sidewalls 50 such that the cover 12 cooperates with the sidewalls 50 and base-plate 52 to form a cavity 56 (FIG. 5). In some configurations, the base 14 may include one or more tubular members in addition to or in the alternative to the sidewalls 50 and/or the base-plate 52. In such configurations, the cover 12 and/or the frame 12 may be mounted to the tubular members.

Figure 4:
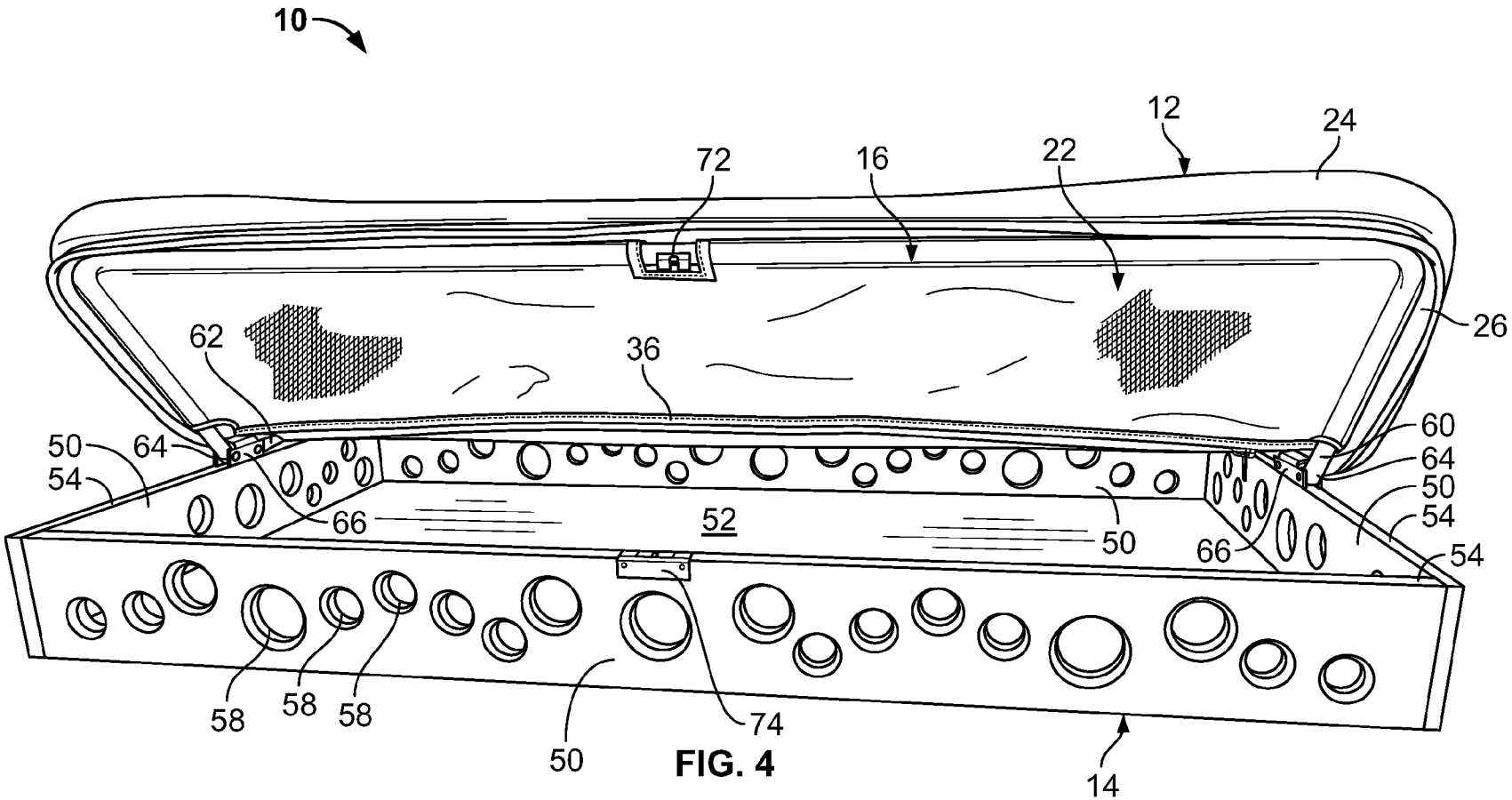
FIG. 4 is a perspective view of the bedding apparatus of FIG. 1 having a frame in an open position.
Figure 6:
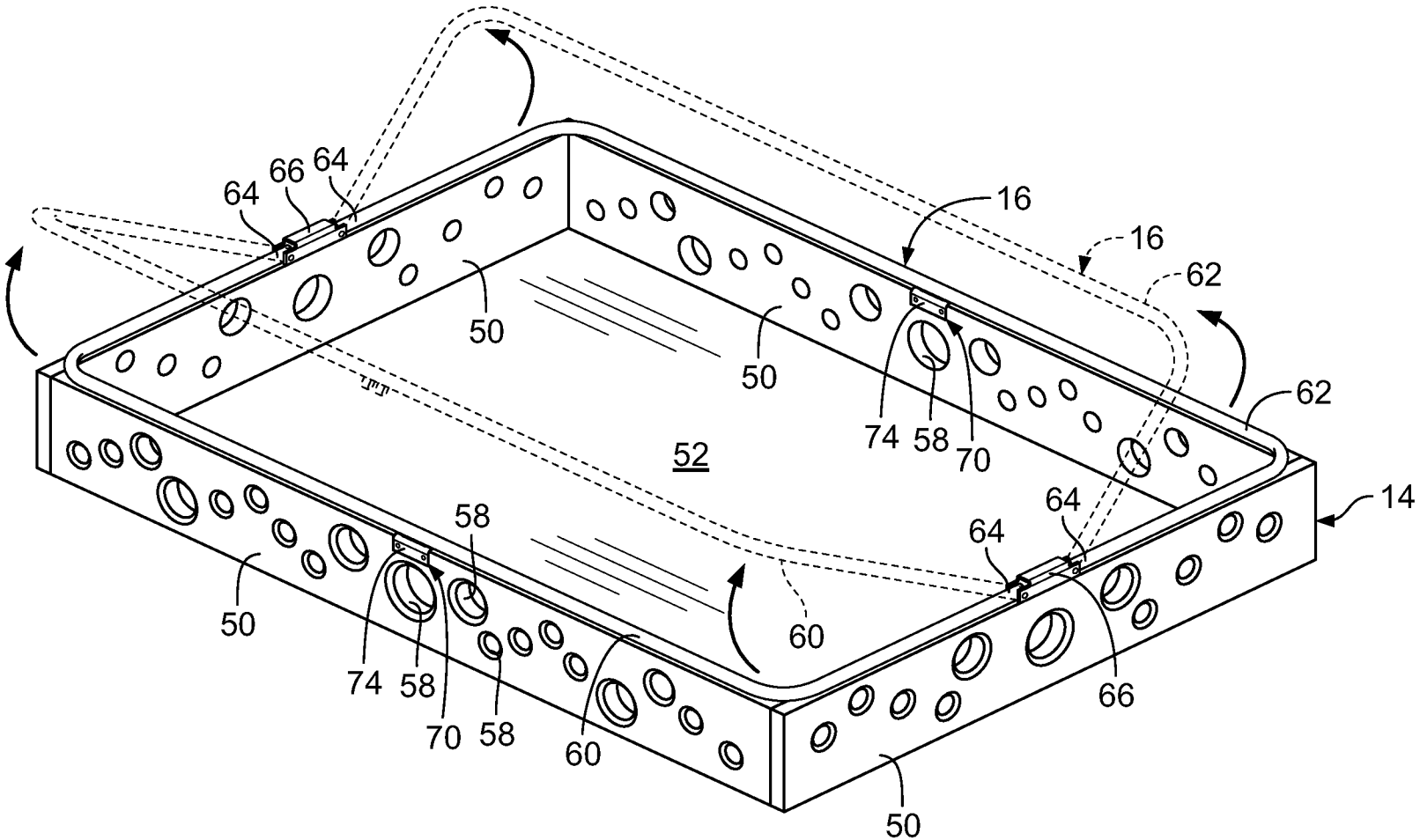
FIG. 6 is a perspective view of a base of the bedding apparatus with the frame moving between the closed and open positions.

The sidewalls 50 may include a plurality of openings 58 extending therethrough in communication with the cavity 56. The openings 58 are vertically spaced apart from the base-plate 52. While the openings 58 are shown in FIGS. 1, 4, and 6 as being generally circular, the openings 58 could be formed in any shape or manner to facilitate aesthetic appeal and airflow into and out of the cavity 56. For example, the openings 58 may be formed in the shape of stars, flowers, balloons, animal heads or any other object or shape.

The frame 16 may function as a tensioning device and may include first and second generally U-shaped rods 60, 62. Corresponding distal ends 64 of the first and second rods 60, 62 are connected to each other and to the base 14 via hinge assemblies 66 fixed to the topsides 54 of the sidewalls 50. The first and second rods 60, 62 may be formed from tubular aluminum or steel, for example, or any other metallic, wooden, polymeric or composite material having sufficient strength and rigidity. For example, the first and second rods 60, 62 may be formed from 0.75 inch (19 millimeter) outer diameter steel or aluminum.

The hinge assemblies 66 allow the first and second rods 60, 62 to pivot between folded or open positions (shown in phantom lines in FIG. 6) and extended or closed positions (shown in solid lines in FIG. 6). The first and second rods 60, 62 may pivot relative to each other and/or the base 14 simultaneously or independently from each other. The hinge assemblies 66 may include springs or other biasing members to urge the first and second rods 60, 62 toward the open positions. Latch mechanisms 70 may securely retain the first and second rods 60, 62 in the closed positions.

Each of the latch mechanisms 70 may include a male member 72 and a female member 74. The male members 72 may be mounted to the first and second rods 60, 62, and may protrude through the openings 40 in the lower layer 22. The female members 74 may be mounted to two opposing sidewalls 50. The latch mechanisms 70 may be spring-loaded such that the male members 72 may be pressed or snapped into engagement with the female members 74. A user may release the engagement between the male and female members 72, 74 by exerting a sufficiently strong upward force on the first and second rods 60, 62 relative to the base 14. It will be appreciated that the latch mechanisms 70 could be any type of latch, clasp, or closure that selectively allow and prevent movement of the first and/or second rods 60, 62 relative to the base 14.

In some configurations, the cover 12 may include one or more pull tabs disposed on a side of the cover 12. The pull tabs may include a loop of fabric or other material extending from the cover 12. The pull tabs may include length and width dimensions of about two and one half (2.5) inches by about one (1) inch (63.5 millimeters by 25.4 millimeters). A user may grasp one or more of the pull tabs to facilitate removal of the cover 12 from the frame 16 and/or installation of the cover 12 onto the frame. Additionally or alternatively, the user may grasp one or more of the pull tabs and pull upward on the tabs to move the frame 16 between the extended position and the folded position or pull downward on the tabs to move the frame 16 between the folded position and the extended position. In some configurations, the pull tabs may include Velcro® or other connecting means. In this manner, multiple pull tabs may be connected to each other while the cover 12 is removed from the frame 16 to retain the cover 12 in a folded position enabling the cover 12 to be more easily fit into a washing machine, a bag, a box or other storage space, for example.

With reference to FIGS. 1-6, operation of the bedding apparatus 10 will be described in detail. As described above, the cover 12 is formed from breathable materials that allow passive flow of gases and liquids therethrough. The frame 16 retains the cover 12 in tension over the base 14 to form the cavity 56. The base 14 may function as a receptacle for bodily fluids and other liquids that may come into contact with the cover 12. The materials and structure of the cover 12 provides a more sanitary sleeping surface for an infant and prevents the infant from re-breathing potentially harmful levels of exhaled carbon dioxide.

To install the cover 12 onto the frame 16, the zipper 36 may first be opened to form an opening between the first and second panels 32, 34 of the lower layer 22. With the first and second rods 60, 62 in the open position (shown in phantom lines in FIG. 6), the first and second rods 60, 62 may be inserted into the opening between the first and second panels 32, 34. In this manner, the first and second rods 60, 62 may be received into the gap 30 between the upper and lower layers 20, 22 such that the first and second rods 60, 62 extend around the perimeter of the lower layer 22. Once the first and second rods 60, 62 are received in the cover 12, the zipper 36 may be closed.

With the cover 12 installed onto the frame 16, the first and second rods 60, 62 may be pivoted about the hinge assemblies 66 into the closed position (shown in solid lines in FIG. 6). To secure the first and second rods 60, 62 in the closed position, the male members 72 of the latch mechanisms 70 may be pressed or snapped into engagement with the corresponding female members 74, as described above. Moving the first and second rods 60, 62 into the closed position applies a tension force on the upper and lower layers 20, 22, such that the cover 12 is substantially taut when the frame 16 is in the closed position. Such tension in the upper and lower layers 20, 22 allows the cover 12 to be suspended over the base 14 and support the weight of the infant while maintaining the spacing between the upper and lower layers 20, 22 forming the gap 30 and the spacing between the lower layer 22 and the base-plate 52 forming the cavity 56.

As described above, the "spacer" fabric of the cover 12 allows substantially free flow of air up and down through the upper layer 20, through the gap 30, and through the lower layer 22. Air passage and circulation is aided by the cavity 56 defined by the base 14 and the openings 58 in the sidewalls 50. Such structure and function allows an infant to lie face-down on the cover 12 and not re-breath carbon dioxide and germs, for example. The "spacer" fabric wicks liquids and moisture away from the outer surface of the upper layer 20, providing numerous health, safety and hygienic benefits over conventional mattresses. The substantially free flow of air also allows the infant to maintain a relatively consistent body temperature compared to conventional mattresses or plastic protective sheets, for example. The cover 12 further provides a resilient support surface reducing the likelihood of plagiocephely (commonly referred to has "flat head syndrome"), which can develop in infants. Furthermore, due to the ease of installation and removability of the cover 12, the bedding apparatus 10 can be quickly and easily removed and washed in a conventional washing machine to remove stains, bacteria, and other matter from the cover 12.

Figure 7:
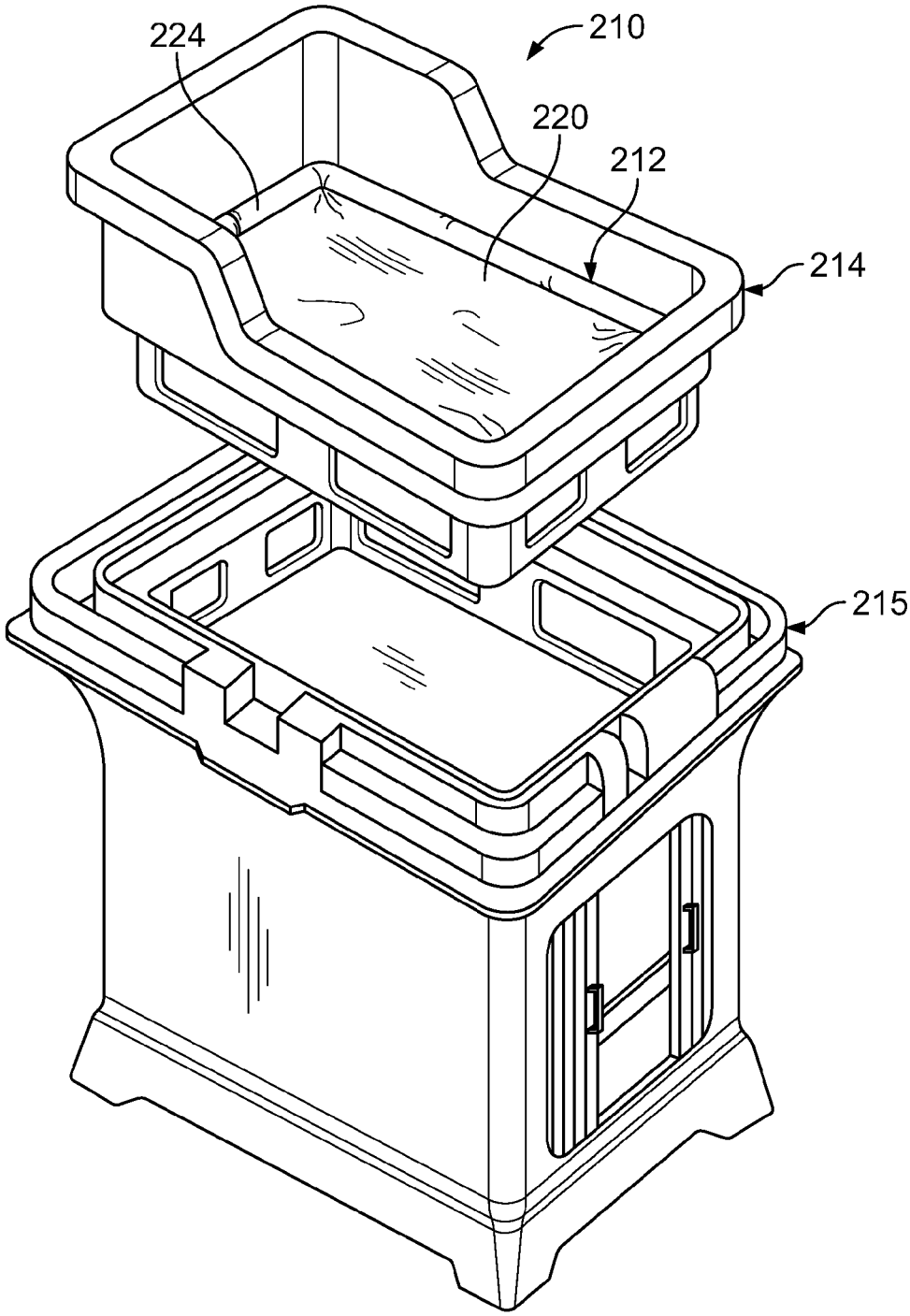
FIG. 7 is a partially exploded perspective view of another bedding apparatus according to the principles of the present disclosure.
Figure 8:
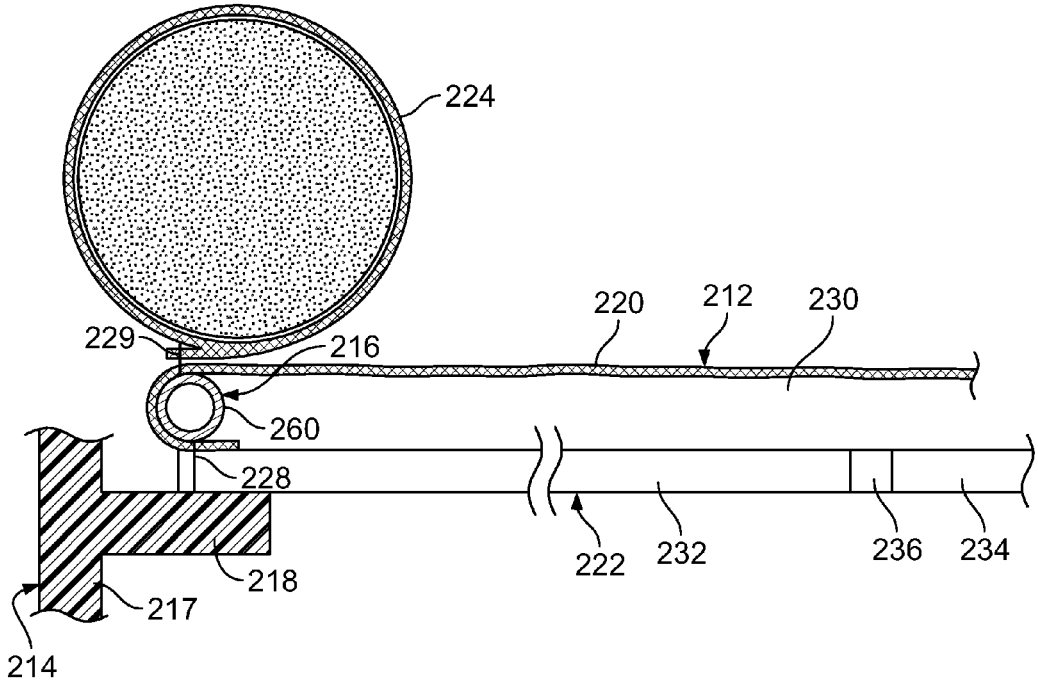
FIG. 8 is a partial cross-sectional view of the bedding apparatus of FIG. 7.

With reference to FIGS. 7 and 8, another bedding apparatus 210 is provided and may include a cover 212, a tray 214, a support unit 215, and a frame 216. The cover 212 may be received in the tray 214, which in turn may be received in the support unit 215. The tray 214 and support unit 215 may be a "bucket bassinet" or other apparatus for use in hospital nurseries and/or maternity wards, for example. The tray 214 may include an interior wall 217 having a continuous support ledge 218 extending inwardly therefrom. The tray 214 may include one or more holes providing airflow to and from the cover 212.

The structure and function of the cover 212 may be generally similar to the cover 12 described above. Therefore, the cover 212 will not be described in detail with the understanding that the description above applies equally to the cover 212. Briefly, the cover 212 may include an upper layer 220, a lower layer 222, and a bumper 224. A first stitched joint 228 may connect the upper layer 220 to the lower layer 222. A second stitched joint 229 may connect the bumper 224 to the upper layer 220. The lower layer 222 may include first and second panels 232, 234 and the zipper 236, which may be substantially similar to the first and second panels 32, 34 and the zipper 36 described above. The cover 212 may be formed without the skirt 26, as the skirt 26 may interfere with the installation or positioning of the cover 212 in the tray 214.

The frame 216 may include a fixed, closed-end tubular member 260 that may closely conform to the interior of the tray 214 so as to rest on the continuous support ledge 218. A relief may be formed in the tubular member 260 to facilitate installation or removal of the cover 212 from the tray 214.

When the zipper 36 is open, the tubular member 260 may be installed between the upper and lower layers 220, 222, thereby maintaining a gap 230 therebetween. The tubular member 260 may fit relatively tightly between the upper and lower layers 220, 222 such that closing the zipper 236 applies a tension or stretching force on the upper and lower layers 220, 222, thereby keeping the upper and lower layers 220, 222 taut or under tension.

It is contemplated that a spring-biased or other adjustable device can be used which tensions or provides the desired stretch and support or deflection characteristics to for the cover 12, 212. All of the advantages of the bedding apparatus 210 described above with reference to the bedding apparatus 10, including the free flow of air through the cover 12, 212, may be equally applicable to the bedding apparatus 210.

Figure 9:
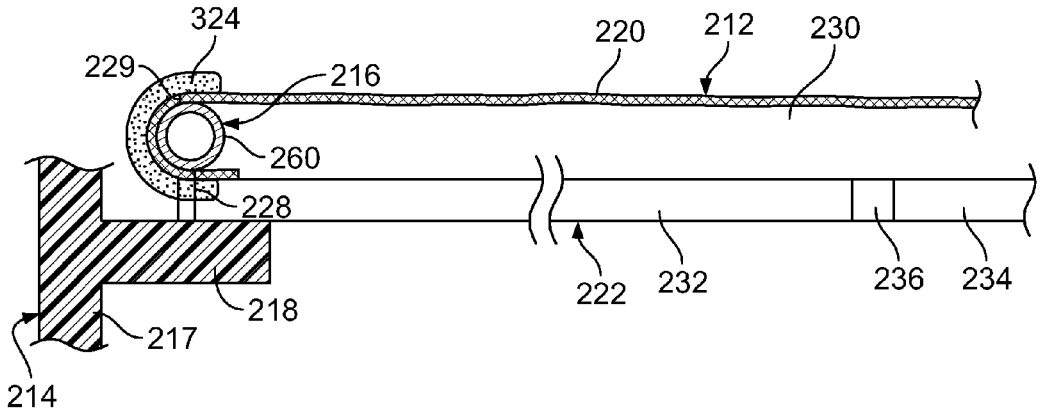
FIG. 9 is a partial cross-sectional view of yet another embodiment of the bedding apparatus.

While the cover 212 is described above as including the bumper 224, in some embodiments, the cover 212 may include a padding member 324 (FIG. 9) instead of or in addition to the bumper 224. The padding member 324 may include a layer of foam, filler material, or any other cushioning material formed to include a generally C-shaped cross-section extending at least partially around an outer diametrical surface of the tubular member 260. The padding member 324 may extend around at least a portion of the periphery of the cover 212 to provide a cushioned buffer between the child and the tubular member 260. The padding member 324 may be connected to the upper and/or lower layers 220, 222 via first and/or second stitched joints 228, 229. It will be appreciated that the padding member 324 may be connected to the upper and/or lowery layers 220, 222 by any other suitable means such as adhesive bonding or hook and loop connection (e.g., Velcro™), for example. In still other embodiments, the padding member 324 may be integrally formed with the upper layer 220 or the lower layer 222.

While the bedding apparatuses 10, 210 are described above as being used with a traditional crib or hospital "bucket bassinet", for example, other embodiments of the bedding apparatus may be configured for use in nanny size cribs, home-use bedside and stand-alone bassinets. Additionally, while the bedding apparatuses 10, 210 are described above as being designed and constructed for infants and toddlers, other embodiments may be configured to accommodate larger children, teens and/or adults.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A bedding apparatus comprising:

a first fabric layer allowing passage of fluid therethrough;

a second fabric layer allowing passage of fluid therethrough, said second fabric layer being connected to said first fabric layer to form a gap therebetween;

a frame engaging at least one of said first and second fabric layers and retaining said first and second fabric layers in a taut condition; and a base defining a cavity over which the first and second fabric layers are suspended.

2. The bedding apparatus of claim 1, wherein said frame is mounted to said base and movable relative thereto between a first position and a second position.

3. The bedding apparatus of claim 2, further comprising a latch mechanism releasably securing said frame in said first position.

4. The bedding apparatus of claim 1, wherein said base includes sidewalls having at least one opening in communication with said cavity.

5. The bedding apparatus of claim 1, wherein said second fabric layer includes first and second panels that selectively engage each other.

6. The bedding apparatus of claim 5, wherein said second fabric layer includes a zipper selectively connecting said first and second panels.

7. The bedding apparatus of claim 1, wherein said first fabric layer is open-weave knitted to allow airflow therethrough.

8. The bedding apparatus of claim 1, wherein said first fabric layer is a three dimensional fabric formed by a warp-knitting process.

9. The bedding apparatus of claim 1, wherein said base is formed from a base-plate and a plurality of sidewalls that cooperate to form the cavity, the cavity providing a receptacle for bodily fluids, wherein at least one of the plurality of sidewalls defines an opening extending therethrough and in communication with the cavity.

10. A bedding apparatus comprising:

a base including a cavity;

a frame mounted to said base and including first and second members, said first member being pivotable relative to said second member between a first position and a second position;

a first flexible layer engaging said first and second members and extending therebetween to form a bedding assembly suspended over said cavity; and a second flexible layer connected to said first flexible layer and forming a gap therebetween, said gap being in fluid communication with said cavity.

11. The bedding apparatus of claim 10, wherein said frame maintains said first flexible layer in a taut condition in said first position.

12. The bedding apparatus of claim 11, wherein said first flexible layer is in a slack condition when said frame is in said second position to facilitate installation and removal of said first flexible layer.

13. The bedding apparatus of claim 10, wherein said first flexible layer is open-weave knitted to allow airflow therethrough.

14. The bedding apparatus of claim 10, wherein said second flexible layer includes first and second panels that selectively engage each other.

15. The bedding apparatus of claim 14, wherein said second flexible layer includes a zipper selectively connecting said first and second panels.

16. The bedding apparatus of claim 10, wherein said base includes sidewalls having at least one opening in communication with said cavity.

17. The bedding apparatus of claim 10, wherein said first and second members are U-shaped rods.

18. The bedding apparatus of claim 10, further comprising a latch mechanism releasably securing said first and second members of said frame in said first position.

19. The bedding apparatus of claim 10, wherein said base is a receptacle for bodily fluids transmitted through said first flexible layer.

20. A bedding apparatus comprising:

a first fabric layer allowing passage of fluid therethrough;

a second fabric layer allowing passage of fluid therethrough, said second fabric layer being connected to said first fabric layer to form a gap therebetween; and a frame engaging at least one of said first and second fabric layers and retaining said first and second fabric layers in a taut condition, said frame including first and second U-shaped rods that are movable relative to each other between a first position and a second position.

21. The bedding apparatus of claim 20, wherein said first and second fabric layers are in said taut condition when said first and second U-shaped rods are in said first position.

22. A bedding apparatus comprising:

a first fabric layer allowing passage of fluid therethrough;

a second fabric layer allowing passage of fluid therethrough, said second fabric layer being connected to said first fabric layer to form a gap therebetween;

a frame engaging at least one of said first and second fabric layers and retaining said first and second fabric layers in a taut condition; and a resiliently compressible padding member extending around a periphery of said first and second fabric layers.

23. A bedding apparatus comprising:

a base including a cavity;

a frame mounted to said base and including first and second members, said first member being pivotable relative to said second member between a first position and a second position;

a first flexible layer engaging said first and second members and extending therebetween to form a bedding assembly suspended over said cavity; and a resiliently compressible padding member extending around a periphery of said first flexible layer.

* * * * *